US005934093A

United States Patent [19]

Liu

[11] Patent Number: 5,934,093

[45] Date of Patent: Aug. 10, 1999

[54] SERVO DEVICE FOR REGULATING A REFRIGERANT INTO A COMPRESSOR

[76] Inventor: Chyi-Pin Liu, 2nd Fl. No. 4, Alley 29, Lane 3, Hualin St., Taipei, Taiwan

[21] Appl. No.: 08/926,399

[22] Filed: Sep. 9, 1997

[30] Foreign Application Priority Data

Sep. 11, 1996 [CN] China ..... 96222644

[51] Int. Cl.[6] ..... F25B 41/04; G05D 23/00

[52] U.S. Cl. ..... 62/217; 236/80 R; 236/84

[58] Field of Search ..... 62/217; 236/80 G, 236/80 R, 84; 417/441

[56] References Cited

U.S. PATENT DOCUMENTS

| | | | |
|---|---|---|---|
| 3,081,604 | 3/1963 | Namisniak et al. | 62/217 X |
| 3,987,642 | 10/1976 | Portoso et al. | 236/84 X |
| 4,447,193 | 5/1984 | Bunn et al. | 417/441 |

*Primary Examiner*—William Wayner
*Attorney, Agent, or Firm*—Bucknam and Archer

[57] ABSTRACT

A servo device for regulating a refrigerant into a compressor comprises a low pressure regulator, a high pressure regulator, and a solenoid valve. The low pressure regulator is connected to an inlet of the compressor and the high pressure regulator is connected to an outlet of the compressor. The solenoid valve is communicating with the low pressure regulator and the high pressure regulator respectively. The low pressure regulator further comprises a cylindrical plunger and a spring. The plunger is located in the low pressure regulator and the spring is located at lower end of the plunger to bias against the plunger. The plunger is pushed to move upward intermittently by a refrigerant coming from the high pressure regulator via the solenoid valve so that the refrigerant entering the compressor is hindered by the plunger to correspond with a state of optimal cooling in an air conditioning system or in a mechanical refrigeration system.

1 Claim, 5 Drawing Sheets

SERVO DEVICE FOR REGULATING A REFRIGERANT INTO A COMPRESSOR

FIELD OF THE INVENTION

The present invention relates to a servo device for regulating a refrigerant into a compressor, and more precisely, relates to a device which can regulate a refrigerant flowing into a compressor intermittently to correspond with a state of optimal cooling in an air conditioning system or a mechanical refrigeration system.

BACKGROUND OF THE INVENTION

A low pressure refrigerant from an evaporator being compressed by a compressor before entering a condenser is a part of a conventional air conditioning system or a conventional mechanical refrigeration system. In order to maintain a state of optimal cooling, the compressor is usually controlled to run intermittently. But, the compressor which is stopped and started again repeatedly will lead to generate great torsional forces which are unfavorable for the running life of the compressor.

SUMMARY OF THE INVENTION

The crux of the present invention resides in the fact that a servo device for regulating a refrigerant flowing into a compressor is provided to avoid the compressor runs intermittently. The servo device consists of a low pressure regulator connected to an inlet of the compressor, a high pressure regulator connected to an outlet of the compressor, and a solenoid valve communicating with both of the regulators. A plunger provided in the low pressure regulator is pushed to move upward intermittently by the refrigerant coming from the high pressure regulator through the solenoid valve. Thus, the low pressure refrigerant flowing into the compressor is hindered properly to correspond with a state of optimal cooling in a air conditioning system or in a mechanical refrigeration system.

An object of present invention is to provide a servo device for regulating a refrigerant flowing into a compressor with which the low pressure refrigerant is hindered to flow into the compressor intermittently to correspond with a state of optimal cooling.

Another object of present invention is to provide a servo device for regulating a refrigerant into a compressor with which the compressor can keep running instead of stopping and starting intermittently.

BRIEF DESCRIPTION OF THE DRAWINGS

The present invention will be further described in detail, by way of example, with reference to accompanying drawings in which.

DETAILED DESCRIDTION OF THE PREFERRED EMBODIMENT

Figure 3:
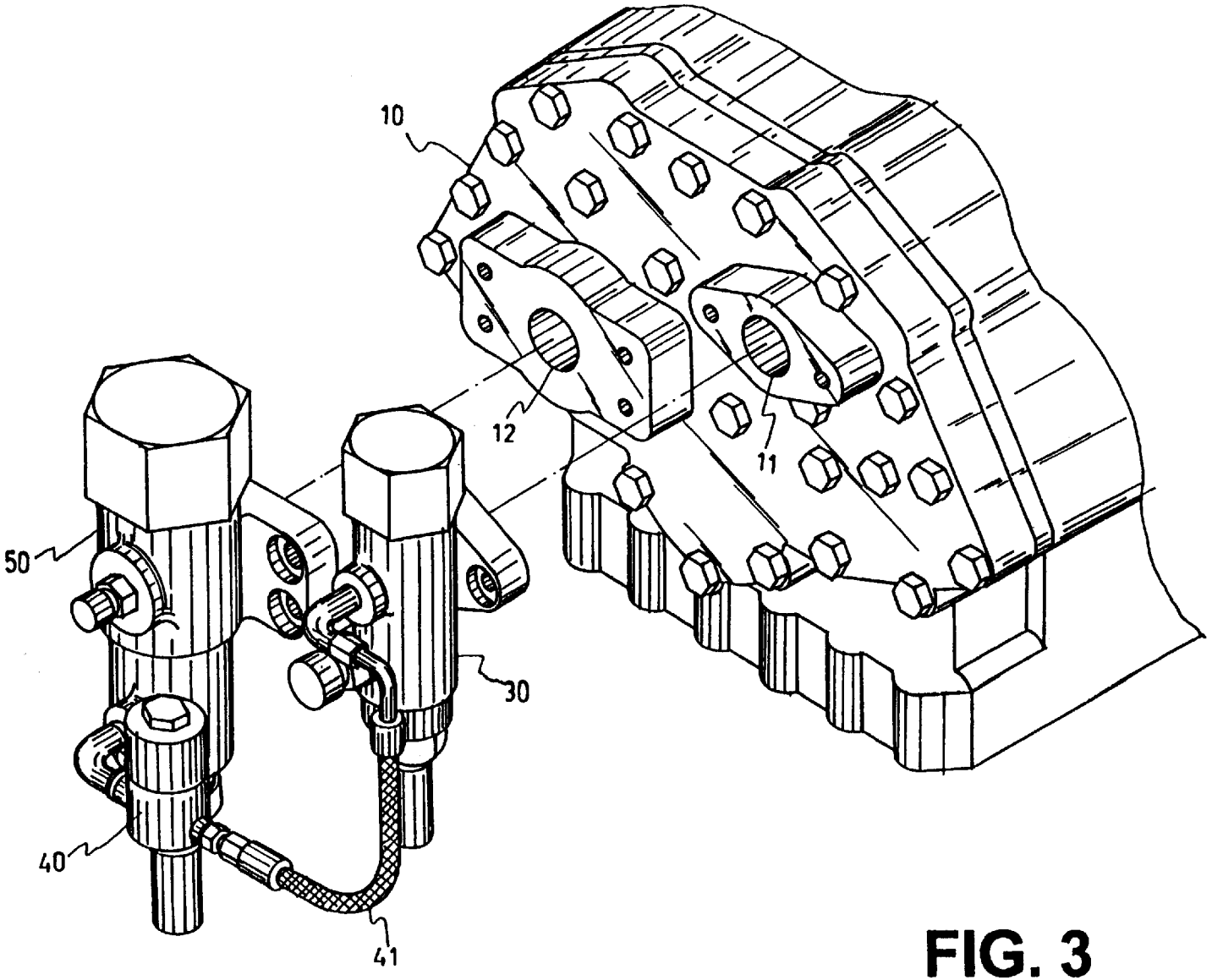
FIG. 3 is a partly disassembled perspective view of an embodiment according to the present invention showing the servo device with a compressor.
Figure 4:
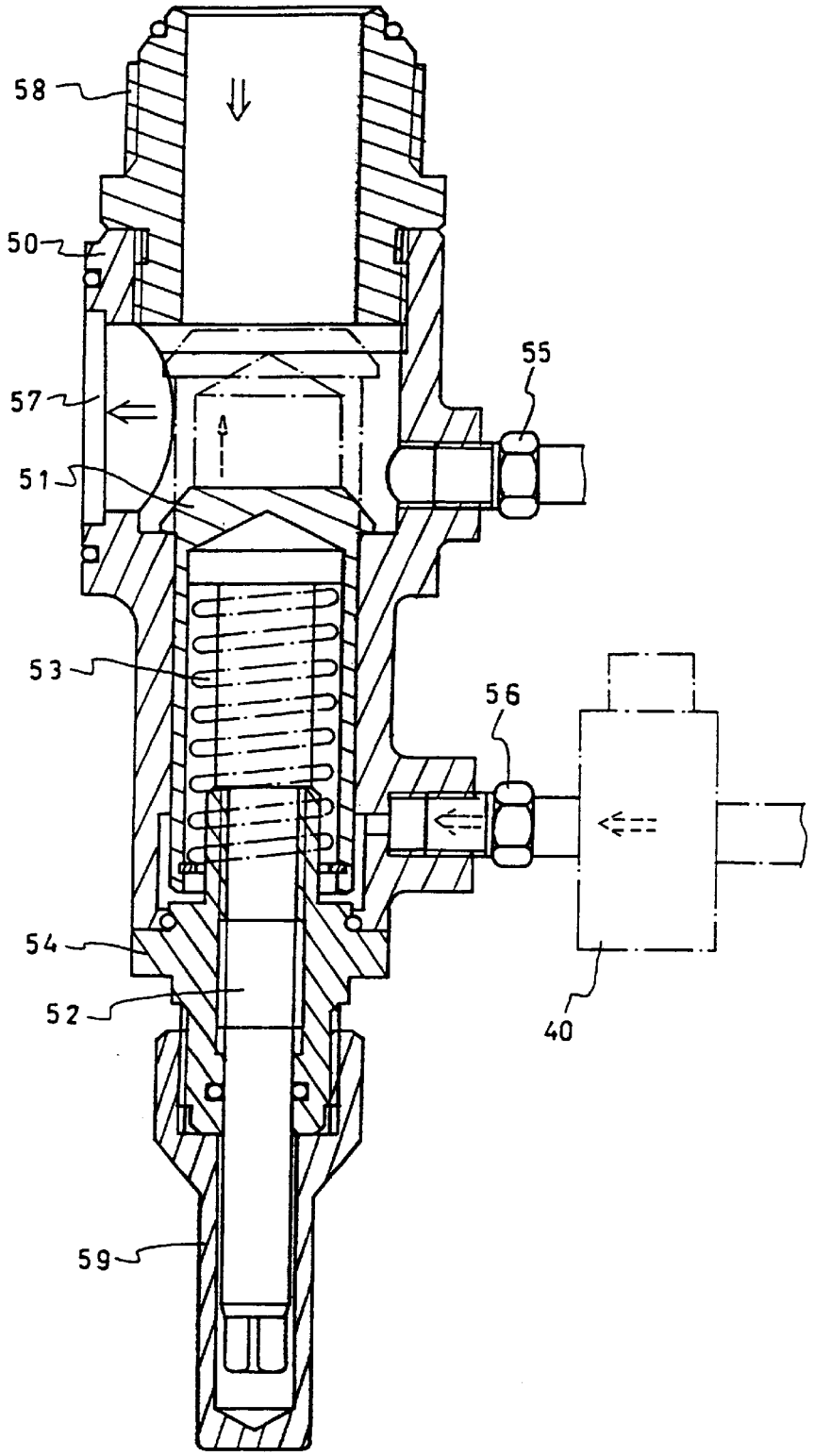
FIG. 4 is a sectional view of the low pressure regulator shown in FIG. 3.
Figure 5:
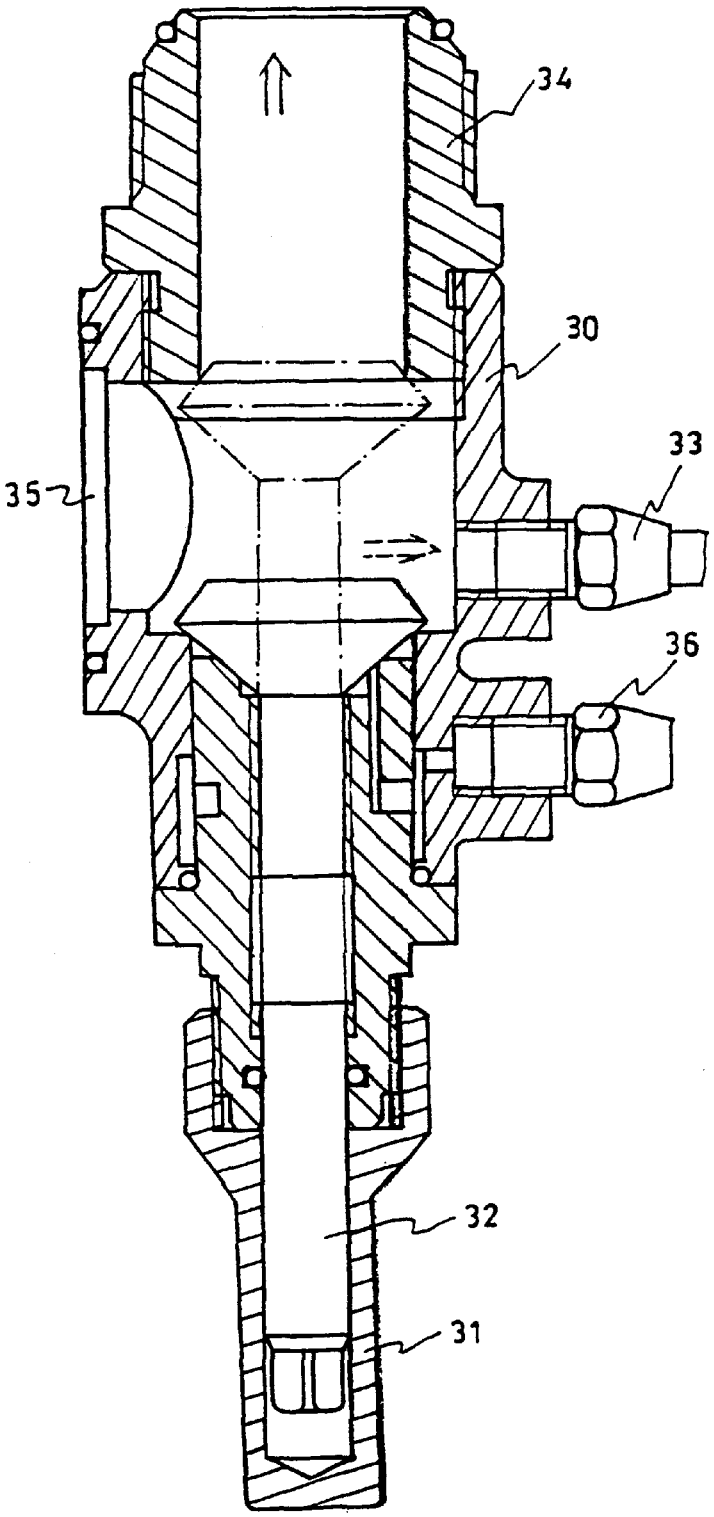
FIG. 5 is a sectional view of the high pressure regulator shown in FIG. 3.

By reference to FIG. 3, FIG. 4 and FIG. 5, the servo device for regulating a refrigerant into a compressor 10 consists of a low pressure regulator 50, a high pressure regulator 30, a solenoid valve 40, and a connecting tube 41. The low pressure regulator 50 comprises a plunger 51, a regulating stem 52, a spring 53, a connector 58, a union 56, a bottom cover 54, and a cap 59. The plunger 51 has a cylindrical inner space for receiving the regulating stem 52 and the spring 53. The regulating stem 52 has an upper part extending into the inner space of the plunger 51 and a threaded middle part. The upper part of the regulating stem 52 has an end of bigger diameter to be biased against an end of the spring 53. The lower end of the plunger 51 has a ring seat to be biased against the other end of the spring 53. The outer casing of the low pressure regulator 50 has an outlet opening 57 in the upper part to connect with an inlet 12 of the compressor 10. The bottom cover 54 is fastened to the outer casing and threaded connected to the middle part of the stem 52. The cap 59 is fastened to the bottom cover 54. The connector 58 is fastened to an inlet opening of the low pressure regulator 50 to connect with a low pressure pipeline 70. There is a lateral opening in the lower part of the low pressure regulator 50 to connect with a solenoid valve 40. The solenoid valve 40 further is fastened a union 56 for connecting an end of the connecting tube 41. Regulator 30 is a conventional regulator comprising a plunger 32 and a cap 31 and has an inlet opening 35 to connect with an outlet 11 of the compressor 10. There is a lateral opening 35 in upper part of the high pressure regulator 30 for connecting the other end of the tube 41 by means of a union 33. A connector 34 in an upper outlet of the high pressure regulator 30 is connected to an a high pressure pipeline 71.

Figure 1:
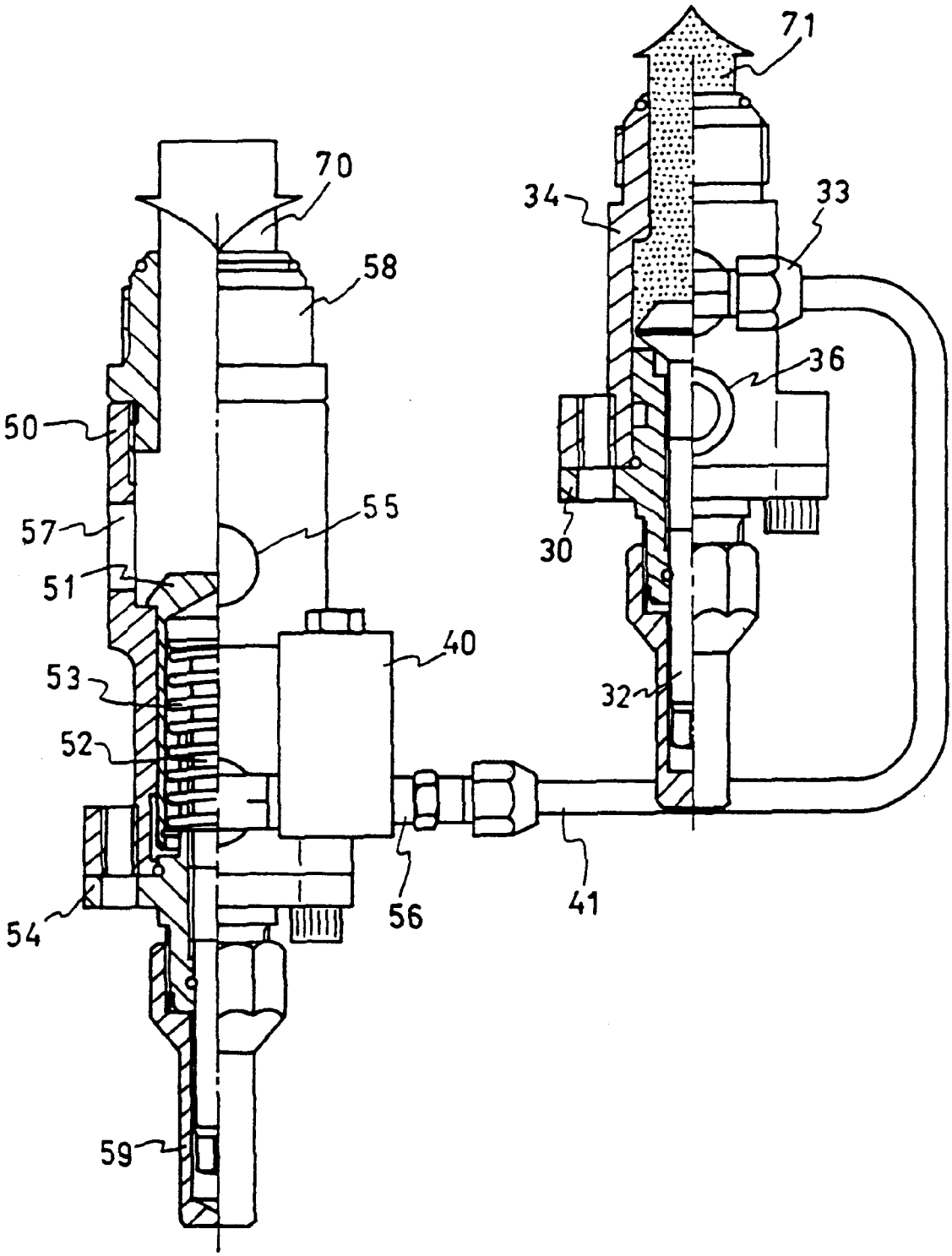
FIG. 1 is a partly sectional view showing a servo device of the present invention in a state of inactivation.
Figure 2:
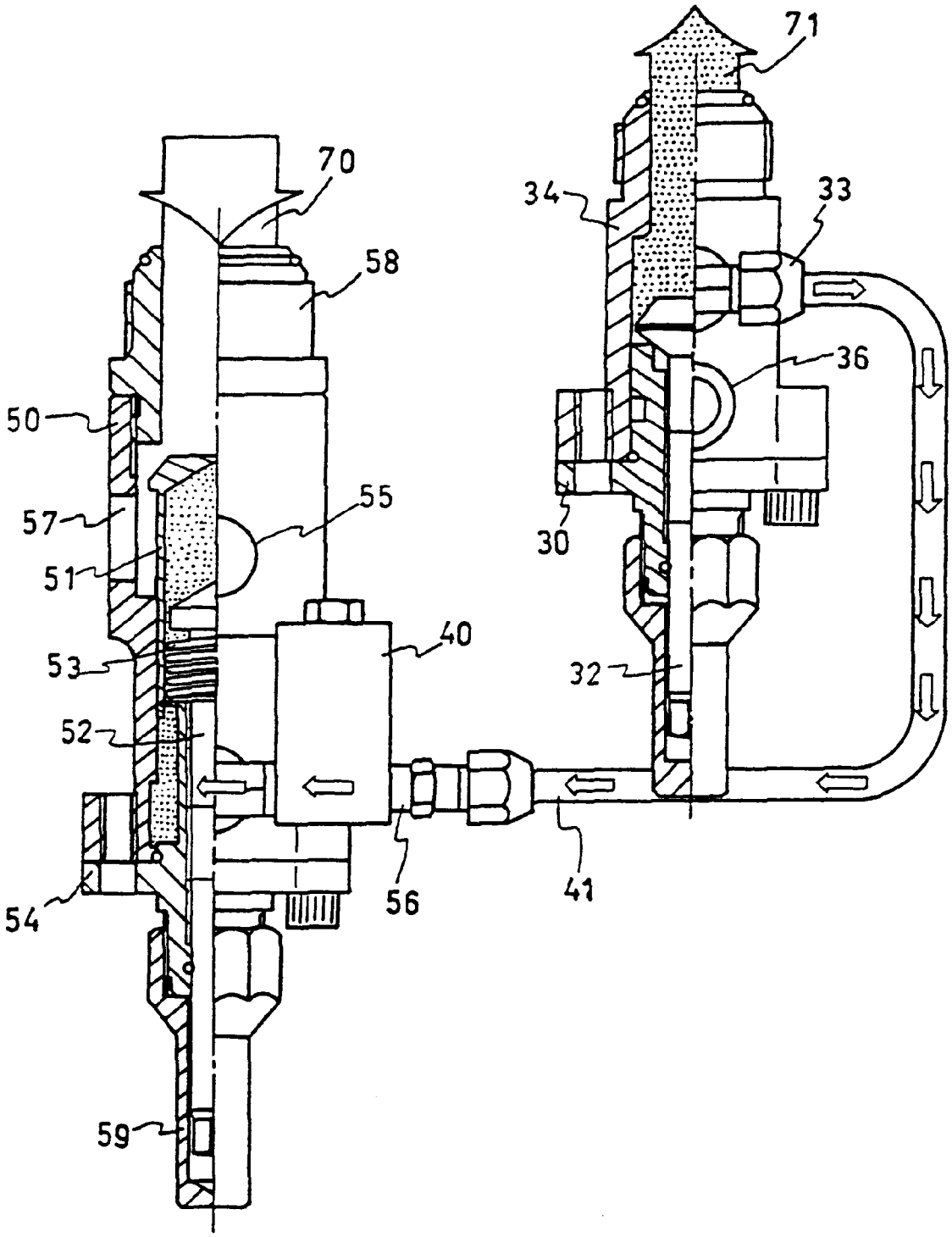
FIG. 2 is a partly sectional view similar to FIG. 1 showing the servo device in a state of action.

Referring to FIG. 1, the operation for the device shown in FIG. 3 will be explained hereinbelow. When a lower limit of the temperature in an air conditioning system or in a mechanical refrigeration system is not reached and the solenoid valve 40 is kept closed, the plunger 51 is pressed downward by the refrigerant coming from the low pressure pipeline 70 and is stayed in the lowest position so that a full amount of low pressure refrigerant will flow into the compressor through the outlet 57. Now, referring to FIG. 2, when the lower limit of the temperature in an air conditioning system or in a mechanical refrigerant is reached and the solenoid value 40 is actuated to open, the high pressure refrigerant in the regulator 30 flows into the low pressure regulator through the tube 40. Then the plunger 51 is pushed to move upward by the high pressure refrigerant against the low pressure force exerted by the refrigerant from the low pressure pipeline 70. Thus, the outlet 57 is hindered by the plunger 51 to leave a small passage for the flow of the low pressure refrigerant. In the meantime, the spring 53 is in a compressed state. When an upper limit of the temperature set is reached and the solenoid valve 40 is actuated to shut off, the high pressure refrigerant in the regulator 30 is blocked to enter the low pressure regulator 50 so that the plunger 51 is pushed to move downward to a uncompressed position with the spring 53 again as shown in FIG. 1.

What is claimed is:

1. A servo device for regulating a refrigerant into a compressor comprising:

a compressor having an inlet and an outlet, a low pressure regulator, said low pressure regulator being connected to said inlet, and further comprising:

a movable cylindrical plunger being located therein, said plunger having a lower end, a spring being located at said lower end of said plunger to bias against said plunger, a high pressure regulator, said high pressure regulator being connected to said outlet, and a solenoid valve, said solenoid valve communicating with said low pressure regulator and said high pressure regulator, respective;

whereby said plunger is pushed to move upward intermittently by a refrigerant coming from said high pressure regulator via actuation of said solenoid valve so that the refrigerant entering the compressor is hindered by said plunger to correspond with a state of optimal cooling in an air conditioning system or in a mechanical refrigeration system.

* * * * *